United States Patent [19]

Rennex

[11] Patent Number: 5,011,136

[45] Date of Patent: Apr. 30, 1991

[54] ENERGY-EFFICIENT RUNNING BRACE

[76] Inventor: Brian G. Rennex, 2332 Antiqua Ct., Reston, Va. 22091

[21] Appl. No.: 269,174

[22] Filed: Nov. 9, 1988

[51] Int. Cl.[5] ..... A63B 23/04; A61H 3/00

[52] U.S. Cl. ..... 272/70; 623/28

[58] Field of Search ..... 272/70, 70.1, 70.3, 272/70.4, 101; 128/25 R, 83.5, 80 R, 80 G; 135/67-69; 623/27, 28

[56] References Cited

U.S. PATENT DOCUMENTS

| | | | |
|---|---|---|---|
| 406,328 | 7/1889 | Yagn | 272/70 |
| 420,178 | 1/1890 | Yagn | 272/70 |
| 420,179 | 1/1890 | Yagn | 272/70 |
| 438,830 | 10/1890 | Yagn | 272/70 |
| 440,684 | 11/1890 | Yagn | 272/70 |
| 1,575,847 | 3/1926 | King et al. | 623/28 |
| 2,206,234 | 7/1940 | Murray | 128/83.25 |
| 2,401,068 | 5/1946 | Green | 128/83.5 |
| 2,923,947 | 2/1960 | Weighill | 623/28 |
| 3,074,715 | 1/1963 | Taylor | 272/114 |
| 3,181,862 | 5/1965 | White | 272/114 |
| 3,486,515 | 12/1969 | Chrysostomides | 135/69 |
| 3,557,782 | 1/1971 | Wafer | 128/80 R |
| 3,765,693 | 10/1973 | Morrison et al. | 280/1.182 |
| 4,030,213 | 6/1977 | Daswick | 36/30 R |
| 4,051,558 | 10/1977 | Vallotton | 623/26 |
| 4,237,625 | 12/1980 | Cole et al. | 36/28 |
| 4,358,902 | 11/1982 | Cole et al. | 36/28 |
| 4,446,634 | 5/1984 | Johnson et al. | 36/29 |
| 4,451,994 | 6/1984 | Fowler | 36/28 |

FOREIGN PATENT DOCUMENTS

| | | | |
|---|---|---|---|
| 247482 | 5/1912 | Fed. Rep. of Germany | 272/70 |
| 365958 | 9/1921 | Fed. Rep. of Germany | 272/70 |
| 2589360 | 5/1987 | France | 272/70 |

*Primary Examiner*—Richard J. Apley
*Assistant Examiner*—David F. Crosby
*Attorney, Agent, or Firm*—Lowe, Price, LeBlanc, Becker & Shur

[57] ABSTRACT

This invention relates to improvements in a resilient leg brace which acts in parallel with a runner's legs to support his or her weight during foot impact, to store the kinetic energy of vertical motion, and to release said energy thrusting the runner back into the air during take-off. The running brace is energy efficient in that it stores and releases the maximum amount of vertical kinetic energy so that the leg muscles do not need to supply as much energy to lift the runner's weight during each step. The running brace also protects the legs and other parts of the body from impact damage. The leg brace is attached to a pelvic harness, and optional back and neck braces are attached to the shoulders and the chin to protect the back and neck from impact shock. The first improvement relates to an asymmetric travel structure which enables the running brace to deliver an upward thrust over a greater distance than that required to absorb the runner's downward impact. This corresponds to the asymmetry inherent in natural running, in that the downward impact is absorbed as the runner's knee bends, whereas the upward thrust is delivered as both the knee and the ankle extend, resulting in a greater distance of action. The second improvement relates to structure which enable the runner to lift his or her foot high when it is being brought forward while the other foot is on the running surface. The third improvement relates to a brake system which allows the runner to stop by preventing the delivery of upward thrust by the running brace.

6 Claims, 6 Drawing Sheets

ENERGY-EFFICIENT RUNNING BRACE

BACKGROUND OF THE INVENTION

This invention relates to running braces and in particular to energy efficient running braces.

This invention augments the effective spring constant of the leg by adding a resilient brace which supports the runner's weight in parallel with the leg.

The act of running involves vertical motion of a runner's center of gravity. The lifting of the runner's weight requires muscle work. When the runner's foot impacts the ground, both the kinetic energy and the momentum associated with the vertical motion must be absorbed. Approximately 45% of the vertical kinetic energy is stored in the resilient parts of the leg and foot, but most of it is lost to the ground and the leg. The lost energy must be replaced by muscle work. This invention is intended to minimize lost energy or, equivalently, to maximize the energy efficiency of running.

Scientific inquiry of running includes the study of the efficiency of running as a function of various parameters. Researchers have been attempting to discover optimized running parameters for greater energy efficiency and fewer injuries. Dr. Thomas A. McMahon of Harvard University discussed how the resiliency of tracks can be tuned to improve performance and safety in his article "Mechanics of Locomotion," T. McMahon, 3 *Int. J. Of Robotics Research* 4 (1984). One of his conclusions is that running times improve by two or three percent and injuries are reduced by a factor of two when the effective spring constant of the track is approximately two times that of a runner's leg. Prior art running shoes cannot achieve improved energy efficiency equivalent to that achieved with tuned tracks, because impact is on the heel whereas take-off is from the toe. Prior art running shoes do not have a means for transmitting the impact energy from the heel to the toe.

Furthermore, the effective spring constant of a leg must be large to achieve high performance, or speed. A drawback of tuned tracks is that the effective stiffness of the leg/track system is smaller than that of the leg itself, since the track acts as a spring in series with the spring representing the leg, and the spring constants of springs acting in series add reciprocally. The present invention solves that problem by having the braces act in parallel with the legs, in which case the spring constants add linearly.

Two important concepts are compliance and resilience. Compliance refers to the property of the sole to give or compress upon foot impact; resilience refers to the property of the sole to return to its original shape. This can be made clearer by referring to a spring model with damping. The term damping includes all friction losses. A spring system may be very compliant by virtue of having considerable damping, but then it is not energy efficient. Prior art running shoes have this drawback. The term resilience as used herein means that damping is minimized, so energy efficiency is maximized. In summary, compliance describes a system where impact energy is dissipated, whereas resilience refers to a system where energy loss is conserved.

Leg-brace devices in the prior art are called walking irons. U.S. Pat. No. 2,206,234 discloses a brace which extends from the foot to the upper leg and it has a spring to cushion the impact of foot strike. However, contact with the ground is made via a pair of feet, each of which is similar to the foot on a pogo stick. This prior art is appropriate for hobbling, whereas the present invention is intended for running—in that the foot strike involves the entire foot, thereby making possible better balance and stability. Another difference is that the cushion springs in the just-mentioned invention act in series with the effective springs of the legs, whereas the brace springs in this invention act in parallel, which leads to higher values of effective spring constant, and which makes possible greatly enhanced performance.

Around 1890, five running brace patents were granted to Nicholas Yagn, a mechanical engineer in the army of the Emperor of Russia, with U.S. Pat. Nos. 420,178; 420,179; 438,830; and 440,684. The first two of these use bow springs, attached to the shoulders and to the pelvis, respectively, to provide parallel support to the legs in running, and, as such, are distinct from the present invention. The third does not provide parallel support to the legs, and, hence, is distinct from my invention. The fourth is based on the unworkable concept that a flexible tube could be made to function like a bow spring by filling it with a sufficiently high-pressure gas.

The fifth patent, U.S. Pat. No. 406,328 describes a brace which provides parallel support for the leg while running. The brace consists of two telescopic members which act against a spring to store the energy associated with the runner's vertical motion. It also provides means for the runner to bend one knee slightly, without compressing the storage spring, during recovery, while the other leg is in contact with the ground. These provisions are necessary, but not sufficient, components of a viable running brace for the following reasons.

The first major drawback in the telescopic design of U.S. Pat. No. 406,328 is due to the fact that, in natural running, the leg absorbs the impact momentum by bending the knee to lower the runner's center of mass approximately 3 inches. The leg then lifts the center of mass by not only extending the knee 3 inches, but also the ankle, perhaps another 5 inches. That is, there is an asymmetry in the travel of the downward and upward action of the leg during running, referred to hereafter as vertical asymmetry. For a brace to function satisfactorily, it must mimic this vertical asymmetry. None of the Yagn inventions provide for this requirement.

Second, the telescopic design of U.S. Pat. No. 406,328 positions the bottom of the brace behind the foot, which means that its thrust will necessarily occur too soon to aid in running and with a smaller amount of travel than if the brace were positioned at the side of the foot. That is, the vertical asymmetry afforded by the Yagn design would be the opposite of that required to aid in natural running, and, hence, Yagn's invention could not work.

Third, the telescopic design of U.S. Pat. No. 406,328 does not allow the foot to be lifted a sufficient distance, during recovery, to allow for natural running. Its foot lift is limited to less than a third of the brace length. In natural running, the ability to lift the foot high improves performance. By shortening the leg system, its moment of inertia about the hip joint is decreased. This reduces the muscle energy required to accelerate the foot forward during recovery. This consideration becomes more important as running speed increases. Finally, the Yagn patents do not provide for a rapid means to stop.

My invention provides for these essential capabilities, i.e., vertical asymmetry, adequate foot lift, and rapid braking, which are not covered in Yagn's inventions or in any other prior art.

SUMMARY OF THE INVENTION

Accordingly, one object of the present invention is to provide a running brace for improved performance that will make running more enjoyable and satisfying.

Another object of the present invention is to provide a running brace that will reduce injuries.

A further object of the present invention is to provide a running brace that will provide a high level of energy efficiency and adequate safety on existing non-compliant surfaces, such as concrete.

Another still further object of the present invention is to provide a running brace that has the ability to dramatically reduce impact shocks on the foot and body to compensate for weakened body parts, with a concurrent significant increase in running speed and energy efficiency.

Another object of the present invention is to provide a running brace that corrects for orthopedic problems of the legs, back, and neck.

Another object of the present invention is to provide a structural design that is optimized in regard to lightness and energy efficiency for development of artificial robotic legs.

Yet another object of the present invention is to make possible various recreational applications based on the ability to bound high into the air.

Another object of the present invention is to reduce injuries in activities such as parachuting in which the parachutist may land dangerously hard on his legs.

Another object of the present invention is to provide a running brace which imitates natural running.

Yet another object of the present invention is to have a running brace which allows the wearer to run on flat or hilly terrain, to run slowly or quickly, and to brake rapidly.

Other objects of the present invention will be apparent to those skilled in the art from the specification and drawings.

Briefly, in accordance with one embodiment of this invention, the foregoing objectives are achieved by providing a running brace which transmits the force and energy of the runner's impact from a pelvic harness to a storage means in said running brace. At the proper time this energy is released to contribute to the thrust of the runner off of the running surface. This running brace incorporates many improvements not found in the prior art, the most important of which are the capabilities of vertical asymmetry, high foot-lift, and rapid braking.

DETAILED DESCRIPTION OF THE PREFERRED EMBODIMENTS

The basic design motivation is to combine the balance and control capabilities of the foot/leg system with the strength and resilience features of an artificial brace system.

The resilient parts of the leg and body can be modeled with a spring referred to heretofore as the leg spring which has an spring constant $k_L$ referred to heretofore as the leg spring constant. To increase the combined spring constant value of a system of springs they must be combined in parallel. If $k_B$ is the spring constant of the brace, then the combined spring constant, $k_C$, of the leg and brace acting in parallel is given by $k_C = k_L + k_B$.

To improve performance in running it is necessary to increase the effective spring constant of the leg. This results in a shorter foot-contact time, which means that the leg muscles work for a shorter time. Also, there is an increased proportion of flight time, as opposed to foot-contact time. For example, when an antelope pronks, it lands on all four legs (springs) at the same time (in parallel). Thus, its combined spring constant is four times that of a single leg, and that is the secret of its success in fast energy-efficient running.

It is not possible to significantly change the leg spring constant, so one must add another spring in parallel to significantly improve performance; this is the purpose of the brace storage means represented by spring constant $k_B$.

Figure 5:
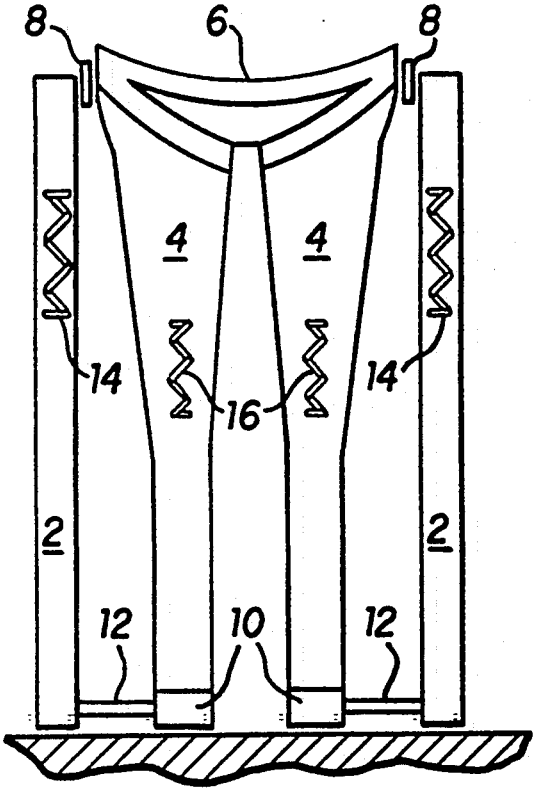
FIG. 5 is a front view of the first leg-brace embodiment of this invention, showing the positions of the braces on either side of the legs and the attachments of the brace to the pelvic harness at the top and to the feet at the bottom.

Referring first to FIG. 5, which shows the positions of the braces on either side of the runner's legs, braces 2 absorb the impact force in parallel with the runner's legs 4. These braces, henceforth referred to as leg braces, are rotatably attached at their top to conventional pelvic harness 6 via conventional swivel 8, and at their bottom to soles 10 of the runner's shoes via foot-connector means 12. Storage means 14, such as conventional springs, are located within the leg braces as described hereinafter. Each of these springs has a spring constant $k_B$. Leg springs 16, which simply model the resilient property of the leg, have spring constants $k_L$. Since the various springs act in parallel, their spring constants add linearly to give a larger value for the effective spring constant of the system.

Since the force on each support element, the leg and the leg brace, is proportional to its spring constant, the portion of impact borne by the leg can be decreased by increasing the spring constant of the leg brace. Then, the leg will not receive as much impact shock.

The outside part of the first embodiment of the invention is shown in side front view in FIGS. 1–4. It is understood that these figures represent one of the two leg braces 2 shown in FIG. 5. Inner telescopic tube 20 slides in and out of outer telescopic tube 22, ensuring that the leg brace can compress without binding of the two telescopic parts. Inner telescopic tube 20 is rigidly attached at its top to pelvic plate 24, which in turn is rotatably attached to pelvic harness 6 via swivel 8 in FIG. 5. The bottom of outer telescopic tube 22 is rotatably attached to the foot 26 by a system including foot-lift collar 28, foot-lift guide 30, rocker foot 32, and foot-lift release means 34, discussed in greater detail hereinafter.

The energy-storage means consists of upper spring 36 and lower spring 38. The telescopic ratchet means consists of two telescopic ratchets which allow a particular sequence of engagements and disengagements of the telescopic parts. The objective is first to store the runner's impact energy in the two sets of springs with the springs acting in parallel, and second to release this energy with the springs acting in series. This means that the thrust travel is twice the impact travel, which mimics the way the leg acts in natural running.

The outer telescopic ratchet consists of outer telescopic pawl 40 and outer ratchet tube 42 with ratchet teeth on the outside and with inner lip 43, which receives the action of upper spring 36. The inner telescopic ratchet consists of inner telescopic pawl 44 and of inner ratchet tube 46, which is the upper part of outer telescopic tube 22. Below this inner telescopic ratchet is a stop means for receiving the action of lower spring 38. It consists of collar 50 at its top, which is fixedly attached to inner telescopic pawl 44, partial collar 48 extending down inner ratchet tube 46, and outer lip 52, which receives the action of lower spring 38. The top of lower spring 38 acts against pelvic plate 24 via extension tube 56. Outer lip 52 is fixedly attached to the bottom of lower spring 38 and outer telescope pawl 40 is fixedly attached to the top of lower spring 38.

Figure 3:
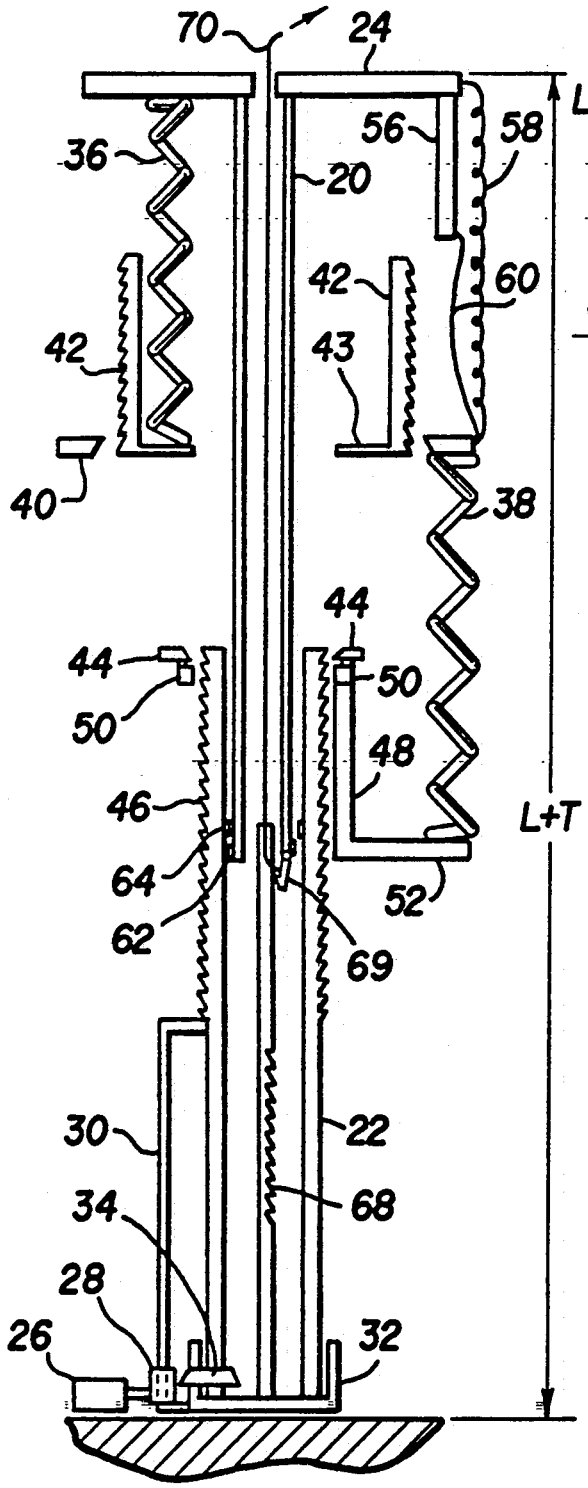
Figure 4:
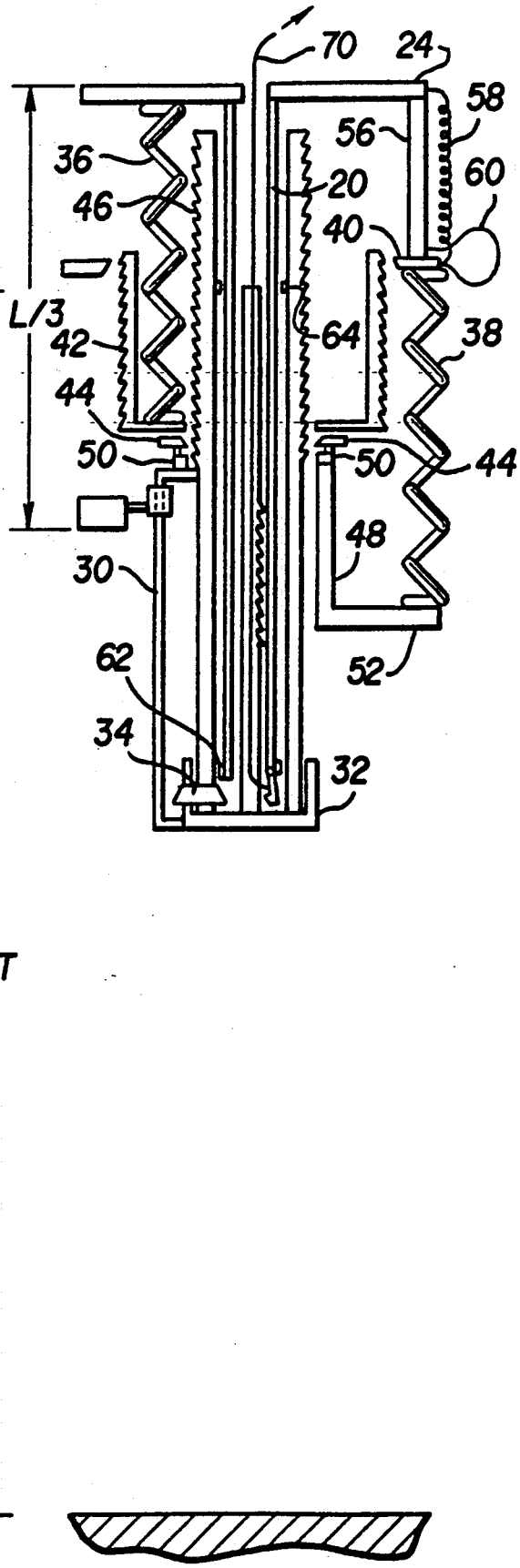

Recovery spring 58 returns outer ratchet pawl 40 and the attached lower spring 38 back to the initial position before foot strike, shown in FIG. 5, and after "recovery" (defined as the period of time when the runner's foot is not in contact with the running surface), shown in FIG. 4. Lower-spring cable 60 prevents outer-ratchet pawl 40 from falling below the bottom of outer ratchet tube 42, as shown in FIG. 3.

Finally, lower tab 62 and upper tab 64 prevent outer telescopic tube 22 from falling, with respect to inner telescopic tube 20, below the position shown in FIG. 3.

Figure 1:
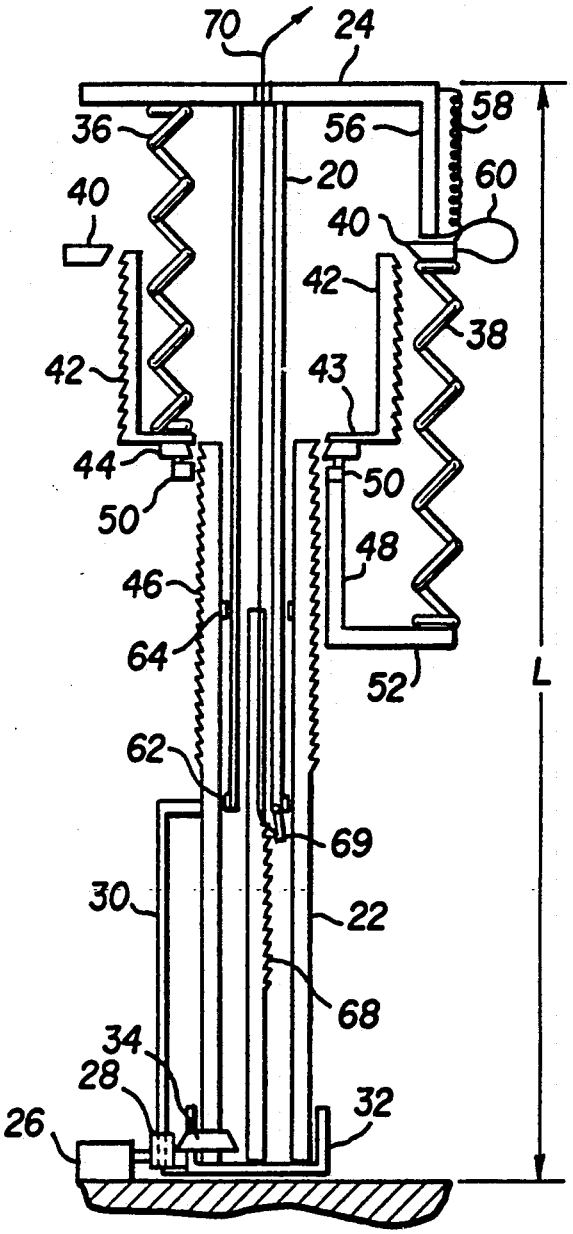
FIGS. 1–4 are cross-sectional views of the first leg-brace embodiment of this invention, showing the telescopic design, springs at two vertical levels for vertical asymmetry, and means for high foot-lift. These figures are in sequence and show relative positions of the telescopic members just before foot-strike (FIG. 1), at maximum compression during foot-strike (FIG. 2), at maximum extension during recovery (FIG. 3), and at maximum compression during foot-recovery (FIG. 4).

The sequence represented by FIGS. 1–4 indicates the functions of the various parts of the first embodiment of the invention during a full running cycle, consisting of the foot-strike period during which the foot is in contact with the running surface and the recovery period during which it is not. During the initial part of foot strike the brace is shortening or compressing, while during the latter part of foot strike the brace is lengthening or expanding. As indicated above, the amount of expansion must be approximately twice the amount of compression in response to movement of the leg during running. FIG. 1 occurs at the beginning of foot strike, FIG. 2 in the middle of foot strike when the knee is at maximum bend, and FIG. 3 just at the end of foot strike when both the leg, including the knee and the ankle, and the leg brace are at maximum extension. FIG. 4 occurs in the middle of recovery when both the leg system and the leg brace are at maximum compression.

During foot strike, storage springs 36 and 38 are engaged in capture and return of the kinetic energy associated with the runner's impact momentum. It is understood that the springs could be of many types, such as a helical spring, an air spring, a flat spring, a carbon composite, or a resilient plastic. The brace elements are constructed of light, strong material such as aluminum, composites, or plastic.

Figure 6:
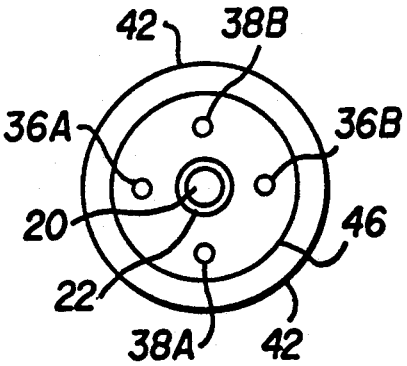
FIG. 6 is a top view of the first leg-brace embodiment, showing the location of the two sets of springs in relation to the telescopic parts.

It should also be understood that the preferred design of the leg-brace has a pair of upper springs 36A and 36B (FIG. 6), located in diametrically opposed position around the inner and outer telescopic tubes 20 and 22, in place of the single upper spring shown in FIG. 1. Likewise for lower springs 38A and 38B. This feature reduces binding of the telescopic elements and requires that the upper and lower springs 36 and 38 in FIG. 1 are rotated 90 degrees with respect to each other, in top view, as shown in FIG. 6.

Figure 2:
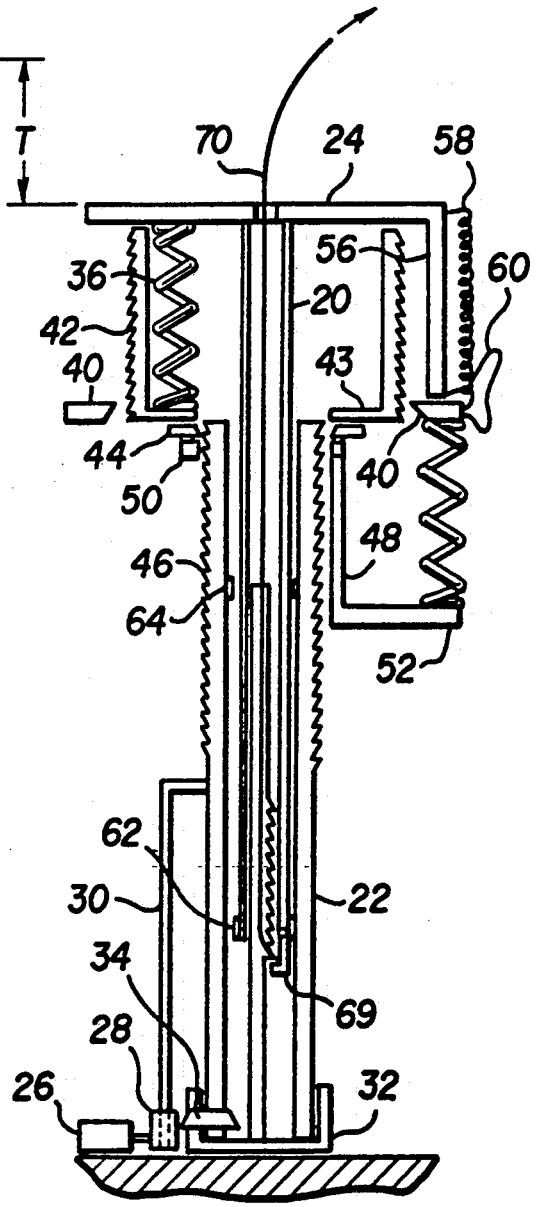

The following is an account of the working of the leg-brace invention, as shown in FIGS. 1–4, throughout a complete running cycle. FIG. 1 shows the leg brace just before foot strike, when the leg brace has length L, enabling it to touch the ground simultaneously with the runner's heel, with the knee unbent. During impact the runner's knee bends to shorten the leg by a distance T; concurrently the leg brace compresses by the same distance T, as each of the storage springs 36 and 38 also compress by T, as shown in FIG. 2.

Figure 7:
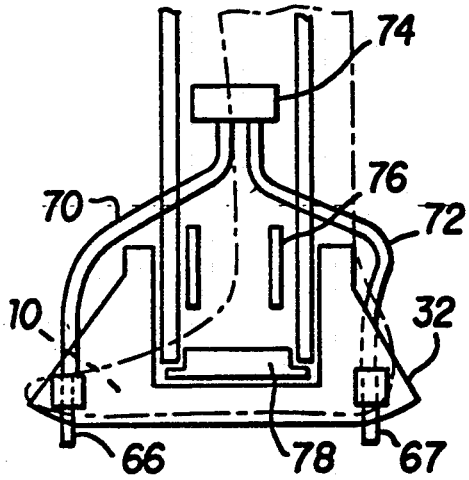
FIG. 7 is a side view of the ratchet trigger, showing the trigger elements in the rocker foot and the cable system used to transmit the trigger to the telescopic ratchet.
Figure 8:
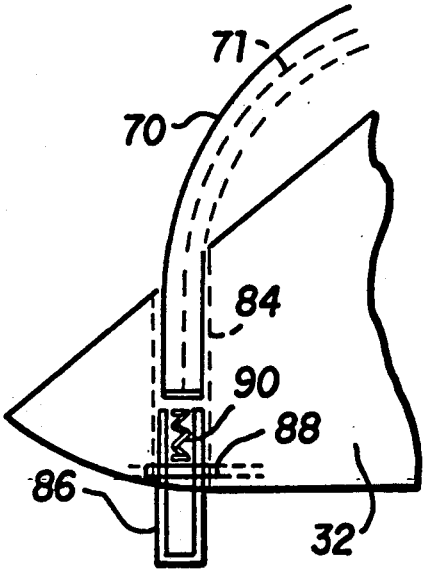
FIG. 8 is a side view of the ratchet trigger, showing detail of a trigger element in the rocker foot.
Figure 10:
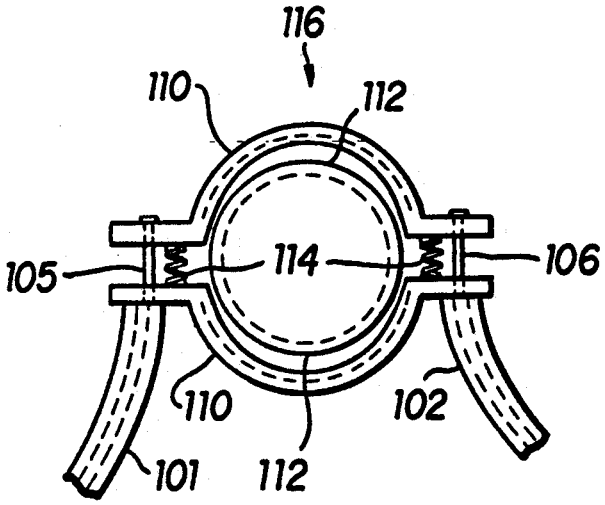
FIG. 10 is a top view of the telescopic ratchet means of this invention, showing the location of the movable outer part which locks onto the inner tubing.
Figure 11:
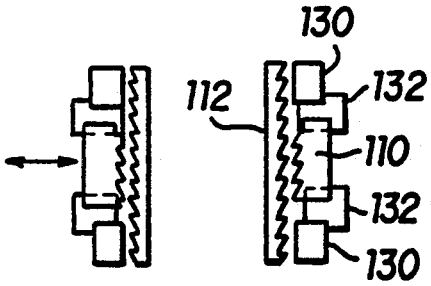
FIG. 11 is a front view of the telescopic ratchet means of this invention, showing the location of the movable outer part which locks onto the inner tubing.

Referring to FIGS. 7 and 8, when the runner's heel first touches the ground, front and back ratchet triggers 66 and 67 in the bottom of rocker foot 32 are pushed up by the ground causing outer and inner telescopic pawls 40 and 44 to engage outer and inner ratchet tubes 42 and 46. The trigger is transmitted to the various ratchets via the cable adapters shown in FIG. 9, and the telescopic ratchet means are shown in FIGS. 10 and 11. The components of FIGS. 7–11 are explained hereinafter.

With reference to FIG. 2, during the initial part of foot strike, inner telescopic tube 20 moves downward within outer telescopic tube 22, causing outer telescopic pawl 40 to move downward with respect to outer ratchet tube 42. At the same time inner telescopic pawl 44 does not move downward with respect to inner ratchet tube 46. This means that both outer ratchet tube 42 and outer lip 52 remain rigidly fixed with respect to inner ratchet tube 46 during impact, ensuring that upper spring 36 and lower spring 38 are compressed in parallel to absorb the runner's downward momentum At the end of compression, when the full downward momentum has been fully absorbed, the runner's leg begins its thrust off of the running surface. At this time upper spring 36 and lower spring 38 begin to expand. The ratchet teeth of outer and inner telescopic pawls 40 and 44 are engaged with the ratchet teeth of outer and inner ratchet tubes 42 and 46, respectively. The effect of these engagements is that the bottom of upper spring 36 acts against the top of lower spring 38, i.e. they act in series during expansion. To summarize, the bottom of upper spring 36 pushes against inner lip 43 which is fixedly attached to outer ratchet tube 42, which is engaged with outer telescopic pawl 40, which pushes against the top of lower spring 38. Finally, the bottom of lower spring 38 pushes against outer lip 52, which is fixedly attached to inner telescopic pawl 44, which engages inner ratchet tube 46, thereby causing inner telescopic tube 20 to move upwards.

Since inner telescopic pawl 44 travels twice the distance of outer telescopic pawl 40 relative to pelvic plate 24, upper spring 36 does not act directly against outer telescopic tube 22. Expansion of lower spring 38 and upper spring 36, acting in series, separate inner lip 43 from inner telescopic pawl 44 in the downward stroke, as shown in FIG. 3. The total travel of inner tube 20 with respect to outer tube 22 is 2T in expansion, as compared with T in compression.

The use of ratchets lends versatility to the design in that the leg brace will work well for any amount of compression, from very little to the maximum. This allows the runner to run slowly as well as quickly, and to run up hills or steps. Lower-spring cable 60 constrains outer telescopic pawl 40 from extending below the bottom of outer ratchet tube 42 (FIG. 3), and recovery spring 58 returns lower spring back to its original position during recovery (FIG. 4).

An alternative embodiment for the telescopic ratchet of FIGS. 10 and 11 would not require teeth on either the telescopic pawl 110 or ratchet tube 112, but instead would rely on gripping force to achieve the ratchet effect. A second alternative embodiment would require only one clamp on one side instead of the two shown in FIG. 10.

The ability to lift the foot high and keep it high when it is brought forward during recovery, is an asset for high performance in running. The reason is that this effective shortening of the leg/leg-brace system reduces its moment of inertia, which reduces the energy required to accelerate the foot forward, during recovery.

Referring to FIG. 7 at the end of foot strike, front ratchet trigger 66 (FIG. 7) is no longer pushed up by the runner's weight, and outer and inner telescopic pawls 40 and 44 disengage from outer and inner ratchet tubes 42 and 46, respectively, using the telescopic ratchet release mechanism described below. This allows outer telescopic tube 22 to be raised by the foot, so as to telescopically slide all the way up inner telescopic tube 20 to the position shown in FIG. 4. The objective here is to allow the runner to lift her foot as much as $\frac{2}{3}$ of the leg length, L. The feature discussed in the previous paragraph achieves $\frac{1}{2}$ of this goal, i.e. $\frac{1}{3}$ L. The other half of the $\frac{2}{3}$ L foot lift is achieved by foot-lift release means 34, which frees foot-lift collar 28 to slide up foot-lift guide 30 to the position shown in FIG. 4. At this point the foot is roughly $\frac{2}{3}$0 L above its straight-leg position. It should be understood that, since the leg is extended behind the runner and not straight down, the foot is actually higher above the running surface than $\frac{2}{3}$ L.

Figure 12:
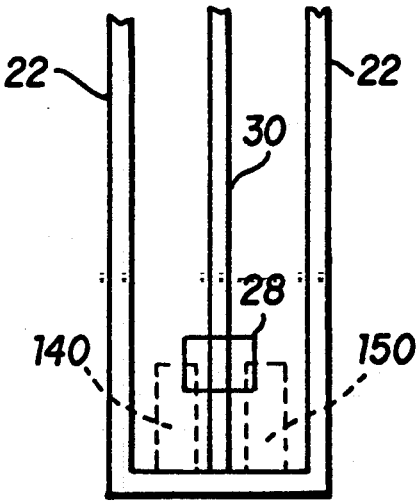
FIG. 12 is a side view of the foot-lift means, showing the relative positions of the inner and the outer foot-lift release means.
Figure 13:
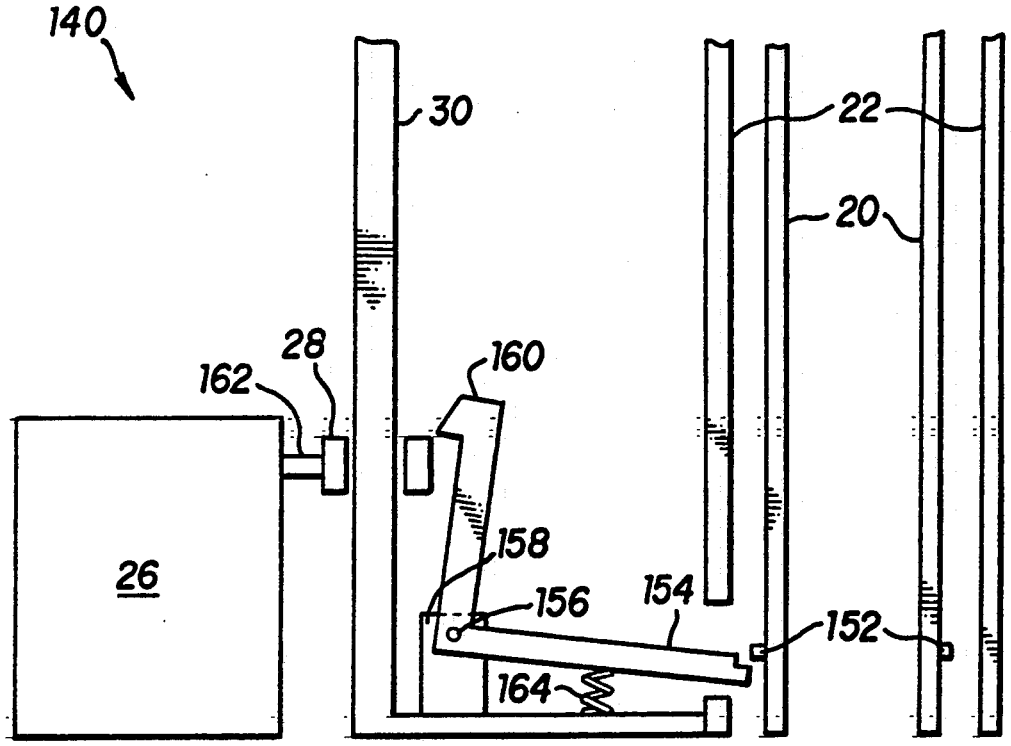
FIG. 13 is a front view of the inner foot-lift release means.
Figure 14:
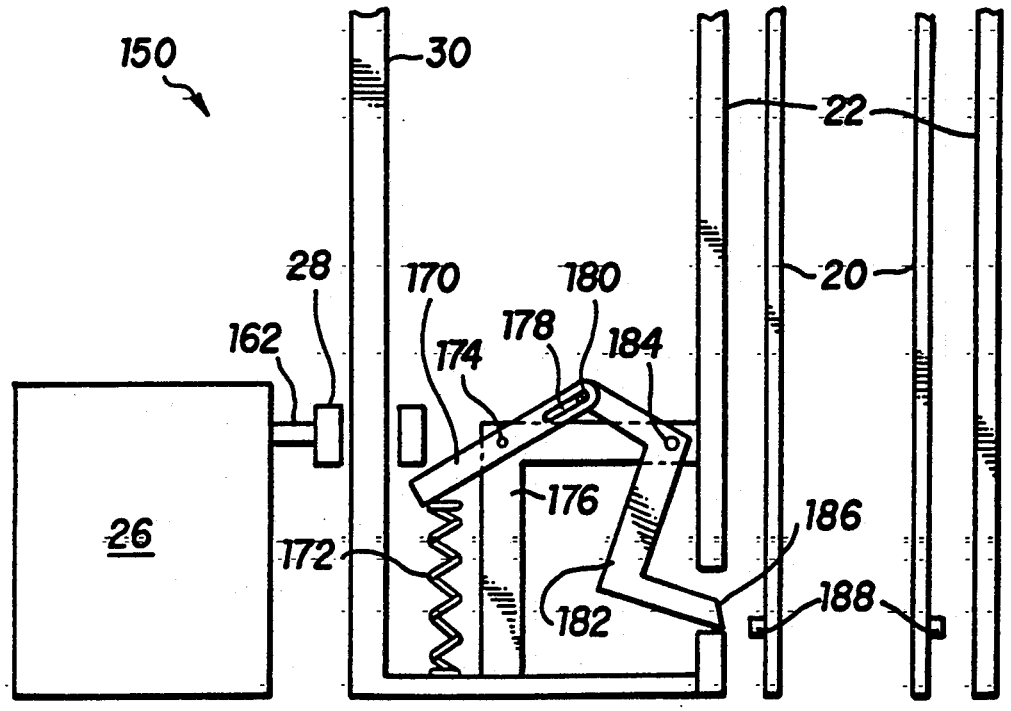
FIG. 14 is a front view of the outer foot-lift release means.

FIG. 12 is a side view of the leg brace showing the adjacent locations of the two components of foot-lift release means 34, i.e., foot-lift means 140 and foot-lift reset means 150. FIGS. 13 and 14 are front views of the bottom portion of the leg brace showing detail on foot-lift means 140 (FIG. 13) and foot-lift reset means 150 (FIG. 14). Foot-lift means 140 acts to free foot-lift collar 28 to slide up foot-lift guide 30, when the foot is lifting during recovery, just after the runner's foot leaves the running surface. Foot-lift reset means 150 acts to reset foot-lift collar 28 at the bottom of foot-lift guide 30, during the latter part of recovery, when the runner straightens her leg just prior to the next foot strike.

FIG. 13 shows the structure of foot-lift means 140. During recovery, when outer telescopic tube 22 has slid all the way up over inner telescopic tube 20 (FIG. 4), foot-lift tab 152 pushes down the horizontal arm of foot-lift lever 154, causing it to rotate in a clockwise direction about foot-lift pin 156, which is housed in foot-lift housing 158. This rotation causes foot-lift catch 160, located at the upper end of the vertical arm of foot-lever 154 to release foot-lift collar 28, allowing it to slide up foot-lift guide 30.

Foot-lift collar axle 162, rotatably attached to foot-lift collar 28, permits the rotation of the runner's foot 26 about the ankle joint during foot strike. This rotation is necessary for maximum leg thrust which includes ankle extension.

When foot-lift tab 152 is not pushing down the horizontal arm of foot-lift lever 154, foot-lift lever spring 164 causes foot-lift lever 154 to rotate counter-clockwise so as to catch foot-lift collar 28 when it slides back down foot-lift guide 30 at the end of the recovery period, when the leg is straightening in preparation for foot strike.

FIG. 14 shows the structure of foot-lift reset means 150. At the end of the recovery period, when the runner's leg is straightening, foot-lift collar 28 slides down foot-lift guide 30 and pushes the end of reset link 170 downward, against reset spring 172. This causes reset link 170 to rotate counter-clockwise around reset-link pin 174, which causes reset lever 182 to rotate clockwise around reset-lever pin 184, by virtue of the connection between reset link 170 and reset lever 182, consisting of reset-link slot 178 and slot pin 180. Both reset-link pin 174 and reset-lever pin 184 are housed in reset housing 176. The clockwise motion of reset lever 182 causes reset lever catch 186, located at the end of the vertical arm of reset lever 182, to release from reset tab 188, which, in turn, permits outer telescopic tube 22 to slide downward with respect to inner telescopic tube 20, resulting in the return of the leg-brace components to the original, pre-foot-strike position shown in FIG. 1.

The purpose of the two means shown in FIG. and 14 is to ensure that the bottom of the leg brace does not extend below the runner's foot when it is near the ground. This prevents the leg brace from dragging along the ground when the runner is walking or running up hill.

In order for inner and outer telescopic tubes 20 and 22 to achieve their minimum combined length during recovery, outer and inner telescopic pawls 40 and 44 must be disengaged from outer and inner ratchet tubes 42 and 46, respectively. This is accomplished by ratchet engaging means 116 (FIG. 10) acting in combination with front and back ratchet triggers 66 and 67 (FIG. 7)

FIG. 10 illustrates the top view of a telescopic ratchet mechanism, (such as outer ratchet tube 42 acting in combination with outer telescopic pawl 40 or inner ratchet tube 46 acting in combination with inner telescopic pawl 44, as shown in FIG. 1). Telescopic pawl 110 is maintained in a disengaged position by ratchet spring 114, except when the runner's foot is in contact with the ground. During that time, upper cables 105 and 106 pull against upper cable casings 101 and 102, respectively, causing the teeth on the opposite sides of telescopic pawl 110 to engage the teeth of ratchet tube 112, at which point the telescopic ratchet is engaged.

FIG. 11 shows a side view of the same telescopic ratchet. Telescopic pawl 110 moves radially along telescopic radial guides 132, which are located above and below it and which are rigidly attached to telescopic pawl center guides 130, which are smooth inner-walled collars that can slide up and down ratchet tube 112 with a minimum of friction and which maintain both semicircular halves of telescopic pawl 110 in a centered position so that they engage and disengage ratchet tube 112 simultaneously.

FIG. 7 shows that at least one of front and back ratchet triggers 66 and 67 are activated during the entire period of foot strike, from heel impact to toe push off. FIG. 8 is a side view of a ratchet trigger. Contact of the runner's foot with the running surface causes trigger tube 86 to move upward within trigger bore hole 84, against trigger spring 90. This causes brake cable casing 70 to move upward with respect to brake cable 71, which is attached to trigger pin 88, and this relative movement transmits the trigger up to telescopic ratchets 110. Trigger pin 8 is rigidly housed in rocker foot 32 through slots in trigger tube 86.

Figure 9:
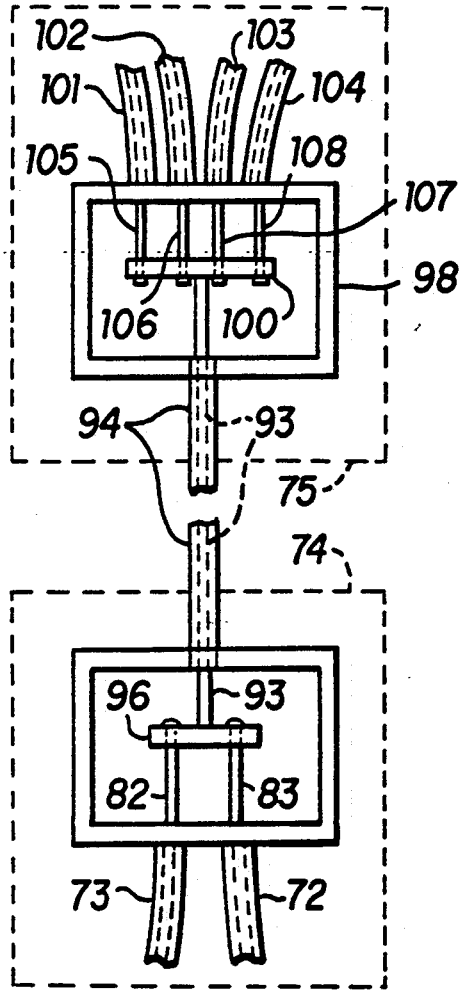
FIG. 9 is a side view of the cable-system adapter used to convert a trigger from one to four cables or from four to one cables.

FIG. 9 shows lower cable adapters 74, which convert the trigger signal from either or both of front and back ratchet triggers 66 and 67, traveling up front and back trigger casings 72 and 73, to a single signal delivered by the relative motions of single trigger cable 93 and single trigger casing 94. The conversion from two cables to one is accomplished by the action of either or both of front and back trigger cables 82 and 83 which pull lower adapter bar 96 downward with respect to front and back trigger casings 72 and 73, which are housed in lower frame 92. The downward motion of adapter bar 96, in turn, pulls down single trigger cable 93 with respect to single trigger casing 94.

In like manner, the transmitted trigger signal delivered through single trigger casing 94 is transmitted to four trigger cables attached to both sides of both telescopic ratchet means (FIGS. 1 and 10), via relative motions of upper casings 101 to 104 with respect to upper cables 105 to 108, using upper adapter bar 100 and upper frame 98.

Referring to FIG. 1, rapid stopping is accomplished via a braking mechanism consisting of the following parts. Brake ratchet 68 is rigidly attached to the bottom of rocker foot 32 and its top extends upward through inner telescopic tube 20. Spring-loaded brake pawl 69 is pivotably attached to the bottom of inner telescopic tube 20, so that it can engage brake ratchet 68, thereby preventing the telescopic expansion of inner telescopic tube 20 with respect to outer telescopic tube 22, which prevents the brace from imparting thrust to lift the runner into the air. Spring-loaded brake pawl 69 is engaged via a trigger mechanism activated by the runner's hand. This trigger mechanism consists of brake cable 71 which extends from the bottom of the inner telescopic tube 20 out through a hole in pelvic plate 24 to a location convenient to the runner's hand, such as the outer surface of pelvic plate 24.

The above description has been of the preferred embodiment of the leg-brace invention.

Note that since the leg brace is attached to the runner only rotatably at the hip and the ankle, the knee is free to bend, which allows the runner both to control the proportion of force borne by the leg brace and to achieve balance while the runner's foot is in contact with the ground. The energy-efficiency objective is best served by minimizing leg work during impact and minimizing the damping in said storage means. Leg and foot extension during take-off imparts energy into the leg/-mechanical system to replace lost energy and to run faster.

It should be understood that many of the design features which can be accomplished in a variety of ways are still encompassed with the scope of this invention. The following is a partial list of these variations in some of the design features.

The bottom of the leg brace, as shown in FIGS. 1 and 5, is located on only one side of the foot. For improved balance, the invention can include a second brace foot, extending from the mid portion of outer telescopic tube 22 over the foot to the ground.

Instead of the high foot-lift feature represented in FIG. 1 by foot-lift collar 28 and foot-lift guide 30, the invention could incorporate a hinge in outer telescopic tube 22, which would allow the foot to lift higher during recovery.

The brake cables for ratchet engaging means 116 shown in FIGS. 8 and 9, for transmitting a trigger signal to engage the telescopic ratchets, could be replaced by conventional hydraulic means in a straightforward manner.

The two sets of springs, upper 36 and lower 38, in FIG. 1 could be augmented by additional sets of springs 15 to achieve a higher ratio between the (1) leg-braces' travel of upward thrust, when the two sets of springs are acting in series, and (2) the travel of downward impact absorption, when the two sets of springs are acting in parallel. That is, the ratio could be 3 or more, instead of 2.

A wide and continuous range of values for this same ratio of upward to downward travel can be achieved alternatively by the use of a small and large air spring with connecting tubes between their air chambers. This embodiment for asymmetric travel will be referred to as the air-spring asymmetric-travel embodiment. During impact, both the larger and the smaller air springs would be free to move in compression to absorb impact energy. During thrust, only the smaller piston would be free to move to impart thrust to the runner. The essential requirement is that the air chambers for both air springs be connected so that the volume of air compressed by both springs expands only the small air spring.

Since its area is smaller, its travel would be greater in proportion to the ratio of piston areas. Means similar to the telescopic ratchet means and the ratchet trigger means, discussed in the preferred leg-brace embodiment above, would be required to ensure that the two pistons act together in compression, while only the smaller piston is engaged in expansion or thrust.

In this case the ratio of upward to downward travel is not limited by the energy storage means. Rather it is limited by the requirements for telescopic action and high foot lift. These two requirements limit this ratio to about 3 or 4, which is adequate for most running applications. A greater ratio can be achieved with the use of 3 or more telescopic elements. Note that a larger ratio value allows the option to locate the brace behind the runner's leg, rather than outside of it.

Figure 15:
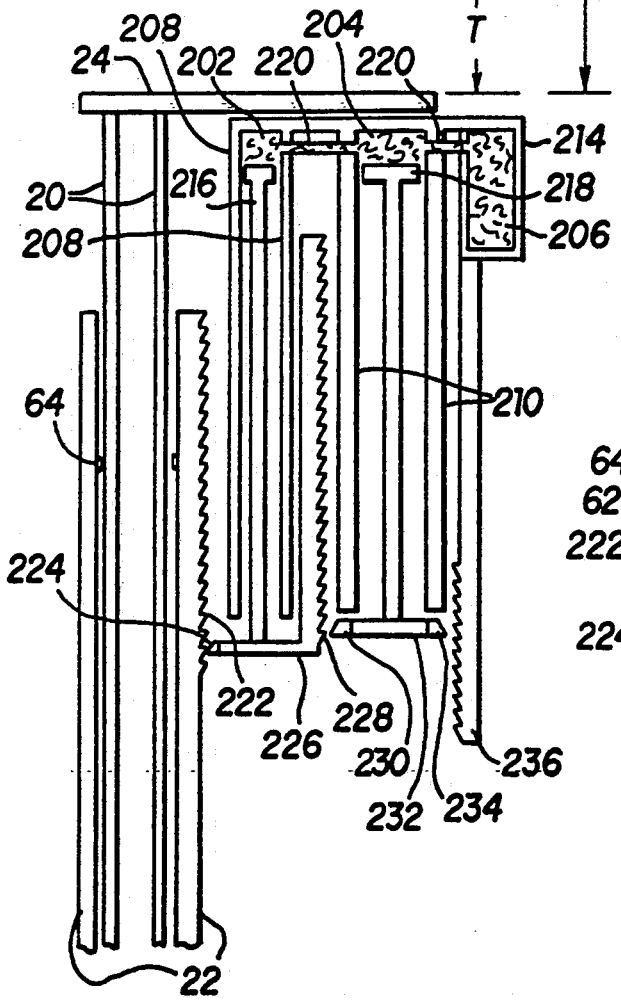
FIG. 15 is a front view of the air-spring, asymmetric-travel embodiment at maximum compression.
Figure 16:
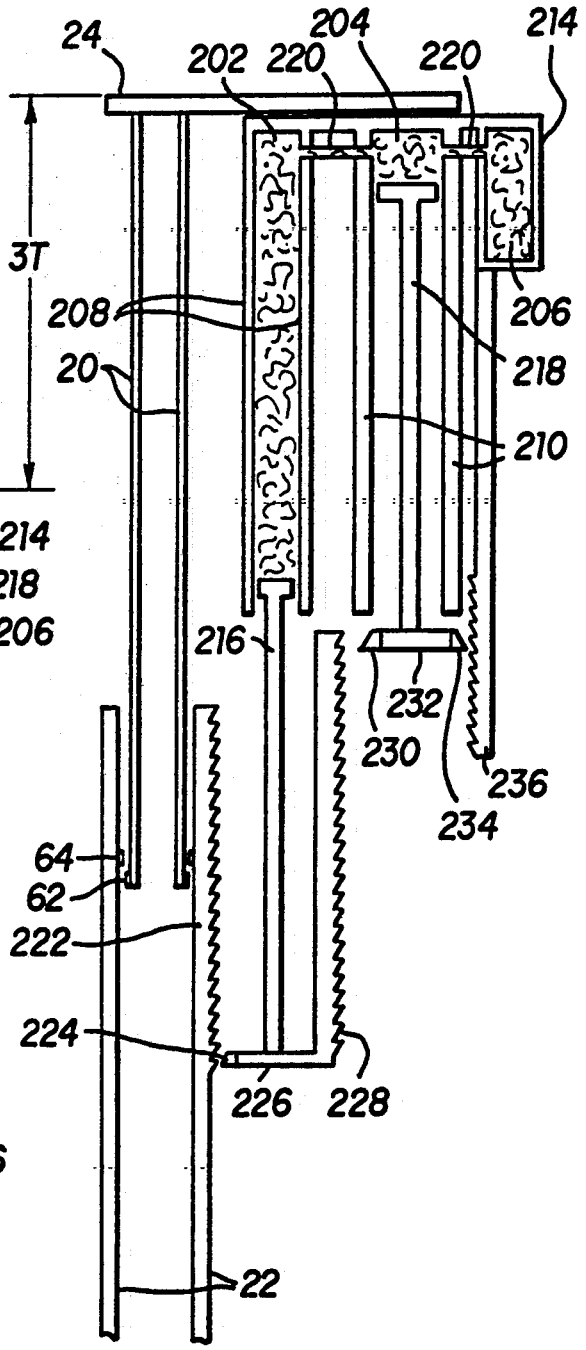
FIG. 16 is a front view of the air-spring, asymmetric-travel embodiment at maximum expansion.

The following is a description of the air-spring asymmetric-travel embodiment shown in FIGS. 15 and 16.

The high foot-lift means and the ratchet-trigger means are the same as is shown in FIGS. 1–4, so only the upper portion of the leg brace is shown. There are three pressure chambers attached to pelvic plate 24: small piston chamber 202, large piston chamber 204, and reservoir chamber 206. These are contained in small piston housing 208, large piston housing 210, and reservoir housing 214; these are compressed by small piston 216 and large piston housing 218; and these are connected by chamber connecting tubes 220. The purpose of the reservoir chamber is to vary the shape of the force vs distance curve of the gas springs.

The bottom of small piston 216 is rigidly attached to small piston support 226, one end of which is rigidly attached to small piston pawl 224 and the other of which is attached to large piston ratchet 228. Small piston pawl 224 engages small piston ratchet 222, which is rigidly attached to the side of outer telescopic tube 22, which in turn slides telescopically around inner telescopic tube 20. Large piston pawl 230 engages large piston ratchet 228 and is rigidly attached to large piston support 232, the other side of which is rigidly attached to large piston catch pawl 234. This engages large piston catch ratchet 236 which is rigidly attached to the bottom of reservoir housing 214.

The air-spring, asymmetric-travel embodiment functions as follows. During the first part of foot strike, the runner's weight causes pelvic plate 24 to move downward a distance T from position 238 to that shown in FIG. 15. This downward motion causes both small and large pistons 216 and 218 to compress the gas in the air chamber comprised of the small piston, the large piston, and the reservoir chambers 202, 204, and 206, thereby storing the energy of impact. This compression occurs because, in like manner to the first asymmetric-travel embodiment, a trigger means causes small piston and large piston pawls 224 and 230, respectively, to engage small and large piston ratchets 222 and 228, during foot strike.

The objective is for only small piston 216 to expand a greater distance of travel, e.g. 3T, during the thrust part of foot strike (FIG. 16). Part of this objective is accomplished via the engagement of large piston catch pawl 234 with large piston catch ratchet 236, which is rigidly attached to pelvic plate 24, via reservoir housing 214. This prevents large piston support 232 (and hence large piston 218) from moving downwards with respect to pelvic plate 24. The remainder of this objective is accomplished by engagement of small piston pawl 224 with small piston ratchet 222 and by the free downward movement of large piston ratchet 228 with respect to large piston pawl 230. Also in like manner to the first embodiment, a system of cables and springs causes the various ratchet and telescopic elements to return to their pre-foot-strike positions during recovery, at which time the various ratchet systems are disengaged. A recovery spring, analogous to recovery spring 58 in the first embodiment, returns small piston 216 to its pre-foot strike position, and a piston stop, analogous to lower spring 60, restrains downward movement of large piston 218.

Finally, the air springs and the ratchet systems shown in FIGS. 15 and 16 can be located either concentrically or adjacent to each other, as well as to the telescopic elements.

The discussion regarding the invention has tacitly assumed a normal running gait in which the runner alternates from one foot to the other. Should research prove that it is possible to achieve a sufficiently high effective spring constant to bound sufficiently high into the air, then it may be possible for humans to run efficiently with a kangaroo gait. That is, the applications of the invention are not restricted to the normal gait. In this case, an additional lower brace in the back, simulating a kangaroo tail, would be helpful for front-to-back balance.

Other applications can be found in the areas of recreation, orthopedics, prosthetics, and robotic running.

Perhaps the most significant safety problem will be to protect the runner from falls from the great heights that could be achieved with this embodiment. In this case, there would be need for a "basket roll-bar" to protect the runner. Similarly, it is entirely possible, in certain applications with relatively higher impact, that additional support members may be needed to ensure structural integrity of the brace system.

The above description shall not be construed as limiting the ways in which this invention may be practiced but shall be inclusive of many other variations that do not depart from the broad interest and intent of the invention.

I claim:

1. In an energy-efficient running brace the improvement comprising:

a harness worn by the user of said running brace;

asymmetric travel means coupled to the harness for absorbing said user's downward momentum over an impact travel distance during impact of said user's foot on a surface and for imparting thrust to said user during thrust off of said surface over a thrust travel distance greater than said impact travel distance;

augmented foot-lift means rotatably attached to the user's foot for lifting the user's foot an additional height beyond that permitted by said asymmetrical travel means during a stride recovery period when the user's foot is not in contact with said surface.

2. The improved energy-efficient running brace of claim 1, wherein said asymmetric travel means comprises:

a plurality of separate energy storage means for storing the runner's foot impact energy;

a plurality of telescopic ratchet means for activating said separate energy storage means in parallel during the initial part of foot strike and in series during the latter part of foot strike;

a plurality of telescopic ratchet trigger means for engaging said telescopic ratchet means during the period of said impact and said thrust when the runner's foot is in contact with said running surface and for disengaging said telescopic ratchet means when the runner's foot is not in contact with said running surface.

3. The improved energy-efficient running brace of claim 1, wherein said augmented foot-lift means comprises:

a foot-lift collar rotatably attached to the user's foot;

a foot-lift guide rigidly attached to said asymmetric travel means for guiding said foot-lift collar and said user's foot longitudinally along aid asymmetrical travel means;

foot-lift release means for allowing said foot-lift collar to move longitudinally along said foot-lift guide during a portion of the period when said user's foot is not in contact with said surface and for preventing said asymmetric travel means from lengthening during said portion of said period.

4. The improved energy-efficient running brace of claim 1, wherein said asymmetric travel means comprises:

first and second gas-spring energy storage means, each of which stores a portion of the user's energy during impact on said surface;

first and second gas-spring ratchet means which together activates said first and said second gas-spring energy-storage means in parallel during impact and which together activate only said first gas-spring energy-storage means during thrust to thereby lift the runner off of said surface;

third gas-spring ratchet means for prevent said second gas-spring energy-storage means from expanding during thrust;

a plurality of ratchet-trigger means for engaging said first, second and third gas-spring ratchet means during the period of said impact and thrust and for disengaging said first, second and third gas-spring ratchet means when the user's foot is not in contact with the ground;

a reservoir gas chamber for varying the forced versus distance curve of said gas-spring energy storage means; and means for connecting said first and second gas-spring energy storage means and said reservoir gas chamber.

5. The improved energy-efficient running brace of claim 1, wherein said running brace further comprises brake means for allowing the user to prevent upward thrust at the end of foot strike, thereby allowing said user to rapidly stop.

6. The improved energy-efficient running brace of claim 5, wherein said brake means comprises:

brake ratchet means for allowing said asymmetric travel means to compress during said impact and for preventing said asymmetric travel means from expanding thereafter;

brake trigger means for allowing the user to selectively engage said brake ratchet means.

* * * * *